US005709001A

United States Patent [19]

Felber

[11] Patent Number: 5,709,001

[45] Date of Patent: Jan. 20, 1998

[54] TRACK WORK MACHINE

[75] Inventor: Hannes Felber, Salzburg, Austria

[73] Assignee: Franz Plasser Bahnbaumaschinen Industriegesellschaft m.b.H., Vienna, Austria

[21] Appl. No.: 760,201

[22] Filed: Dec. 4, 1996

[30] Foreign Application Priority Data

Feb. 5, 1996 [AT] Austria ..... 207/96

[51] Int. Cl.[6] ..... E01H 8/00

[52] U.S. Cl. ..... 15/55; 104/2

[58] Field of Search ..... 15/54, 55; 104/2, 104/7.3, 12

[56] References Cited

U.S. PATENT DOCUMENTS 4,257,331 3/1981 Theurer et al. ..... 104/2
5,172,635 12/1992 Theurer .
5,172,637 12/1992 Theurer .
5,402,547 4/1995 Theurer .
5,452,528 9/1995 Theurer et al. ..... 104/2

*Primary Examiner*—Randall Chin
*Attorney, Agent, or Firm*—Collard & Roe, P.C.

[57] ABSTRACT

A track work machine comprises a machine frame supported by undercarriages on the track for moving in an operating direction, a broom housing, and a ballast broom having a horizontal shaft extending in a transverse direction and rotatably mounted in the broom housing. A holding device is provided for temporarily storing the ballast broom, the holding device being mounted on the machine frame and comprising two bearing arms for supporting the horizontal shaft of the ballast broom, the bearing arms being spaced from each other in the transverse direction. A horizontal guide extends in the transverse direction and displaceably guides the holding device in the transverse direction, and a drive is connected to the holding device for displacing the holding device in the transverse direction.

8 Claims, 2 Drawing Sheets

TRACK WORK MACHINE

BACKGROUND OF THE INVENTION

1. Field of the Invention

The present invention relates to a machine for carrying out work on a track, which comprises a machine frame extending in a longitudinal direction and supported by undercarriages on the track for moving in an operating direction, a broom housing, and a ballast broom having a horizontal shaft extending in a direction transverse to the longitudinal direction and rotatably mounted in the broom housing.

2. Description of the Prior Art

U.S. Pat. No. 5,402,547 discloses a machine of this type, which comprises a ballast broom for sweeping ballast off a track after ballast has been distributed in the track by a ballast plow. In this machine, a ballast plow is vertically adjustably arranged underneath the machine frame and is followed in the operating direction by three spaced apart broom housings carrying rotatable ballast brooms. The front end of the machine frame carries a further ballast broom for replacing a worn ballast broom in one of the broom housings. It is relatively difficult to manipulate the broom during a replacement operation because such ballast brooms carry a great many elastic hoses and, therefore, are quite heavy. Furthermore, in case the track is positioned between two neighboring tracks open to train traffic, serious safety problems arise during replacement operations.

U.S. Pat. Nos. 5,172,635 and 5,172,637 disclose other types of machines for carrying out work on a track and using ballast brooms, i.e. tamping machines and track stabilizers.

SUMMARY OF THE INVENTION

It is the primary object of this invention to provide a machine for carrying out work on a track, which enables the replacement of ballast brooms to be effectuated simply and efficiently.

The above and other objects are accomplished according to the invention in a machine of the first-described type by providing a holding device for temporarily storing the ballast broom, the holding device being mounted on the machine frame and comprising two bearing arms for supporting the horizontal shaft of the ballast broom, the bearing arms being spaced from each other in the transverse direction, a horizontal guide extending in the transverse direction and displaceably guiding the holding device in the transverse direction, and a drive connected to the holding device for displacing the holding device in the transverse direction.

This arrangement makes it possible advantageously to store a new ballast broom temporarily immediately adjacent the broom housing so that, in case of need, the ballast broom may be laid on the track without the need of any bodily intervention of the operating personnel for a ready and simple exchange of the worn broom for the new broom. Because of the transverse displaceability of the holding device, it is also very easy to place respective new ballast brooms on the holding device, for example by a crane, particularly if such new ballast brooms are pre-stored on the machine frame. The same holds true in a reverse operation for the removal of the worn ballast brooms.

According to a preferred embodiment, the horizontal guide is comprised of two guide rails interconnected by a hinge having a vertical axis, one of the guide rails being affixed to the machine frame while the other guide rail is pivotal between an extended position perpendicular to the longitudinal direction and a retracted position extending in the longitudinal direction. On the one hand, this enables the ballast broom to be moved between the crane and the holding device without problems as far away from the machine frame as possible in the transverse direction when the other guide rail is extended. On the other hand, the pivoting capability of the other guide rail assures that the holding device does not project beyond the track gage during operation of the machine.

BRIEF DESCRIPTION OF THE DRAWING

The above and other objects, advantages and features of the present invention will become more apparent from the following detailed description of a now preferred embodiment, taken in conjunction with the accompanying drawing wherein.

DETAILED DESCRIPTION OF PREFERRED EMBODIMENT

Figure 1:
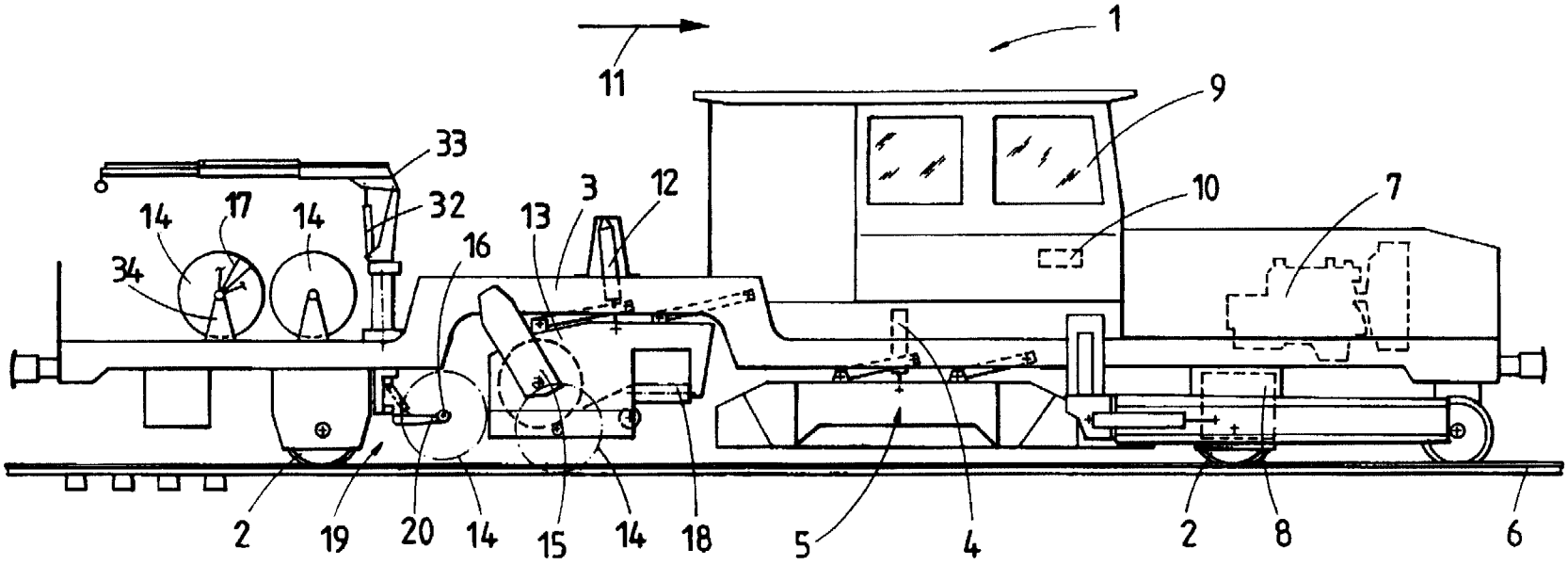
FIG. 1 is a side elevational view of a ballast plow with a ballast broom and a holding device according to this invention.

Referring now to the drawing, there is shown machine 1 for carrying out work on track 6. The machine comprises machine frame 3 extending in a longitudinal direction and supported by undercarriages 2 on track 6 for moving in an operating direction indicated by arrow 11. The machine further comprises ballast plow 5 for distributing ballast in the track. Motor 7 serves to supply power to drive 8, which moves machine 1 along track 6, and to all other operating drives on the machine. Operator's cab 9 houses central control panel 10.

Broom housing 13, which is vertically adjustable by drive means 12 linking the broom housing to the machine frame, is arranged between ballast plow 5 and a rear undercarriage 2, in the operating direction. Ballast broom 14 having horizontal shaft 16 extending in a direction transverse to the longitudinal direction is rotatably mounted in broom housing 13, and the broom shaft is rotated by drive 15. A multiplicity of flexible sweeping elements, such as rubber hoses, extend radially from broom shaft 16. Transverse conveyor band 18 is arranged immediately in front of ballast broom 14, in the operating direction, for conveying excess ballast swept up by the broom to a track shoulder.

Figure 3:
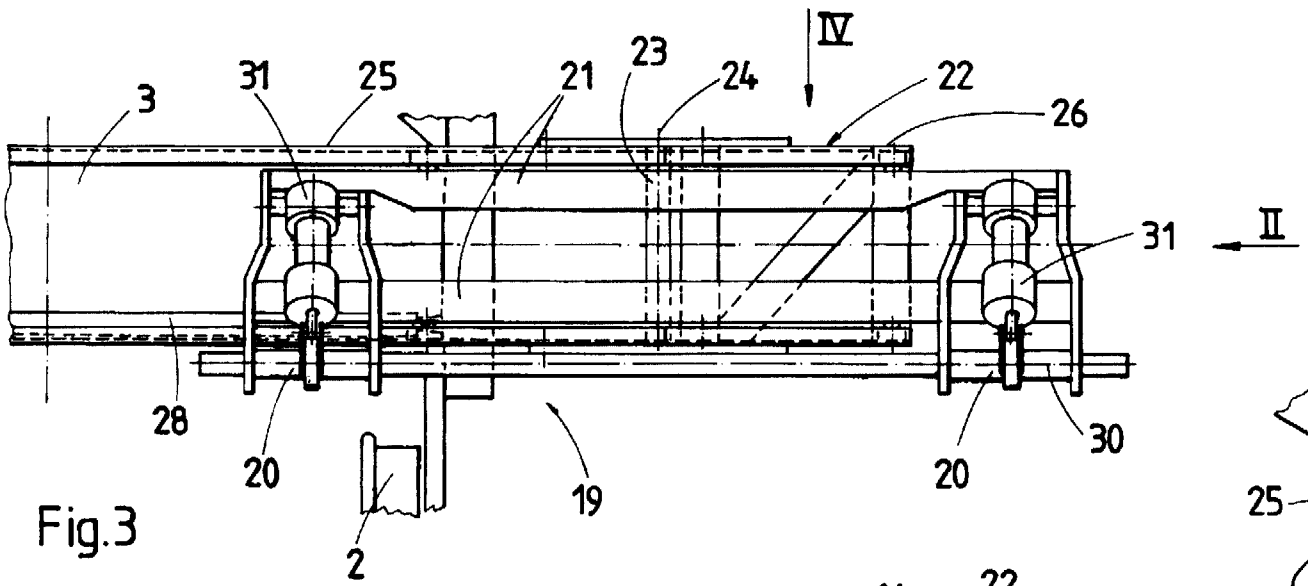
FIG. 3 is an end view of the holding device, taken in the longitudinal direction of the machine frame, the holding device being shown in an extreme transverse position ready for an exchange of a ballast broom and the ballast broom being omitted for the sake of clarity.

Holding device 19 for temporarily storing a ballast broom is arranged between ballast plow 5 and rear undercarriage 2. The holding device is mounted on machine frame 3 and comprises two bearing arms 20 for supporting horizontal shaft 16 of ballast broom 14. The bearing arms are spaced from each other in the transverse direction and extend substantially horizontally in the longitudinal direction of machine frame 3. As shown in FIG. 3, a horizontal guide 22 extends in the transverse direction and displaceably guides holding device 19 in the transverse direction, and drive 28 is connected to the holding device for displacing the holding device in the transverse direction.

Figure 4:
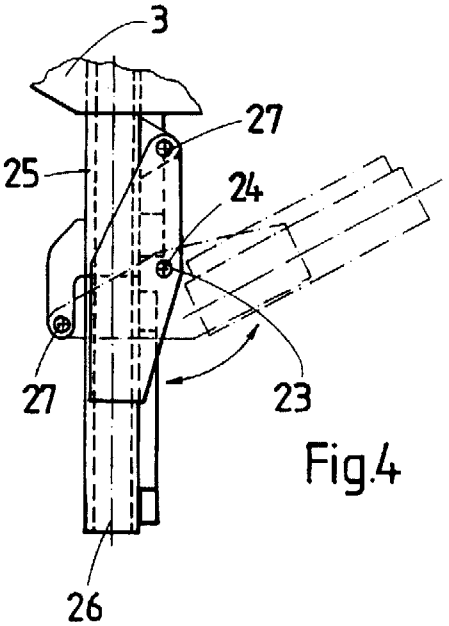
FIG. 4 is a fragmentary top view of the holding device, taken in the direction of arrow IV in FIG. 3, showing the horizontal guide for the holding device projecting beyond the machine frame in the transverse direction.

The illustrated horizontal guide is comprised of two guide rails 25, 26 interconnected by hinge 23 having vertical axis 24, guide rail 25 being affixed to machine frame 3 while the other guide rail 26 is pivotal between an extended position perpendicular to the longitudinal direction (shown in FIG. 3) and a retracted position extending in the longitudinal direction, i.e. at an angle to the operating position, as shown in phantom lines in FIG. 4. Stop means 27 are arranged to lock the other guide rail 26 in the extended and retracted positions.

Figure 2:
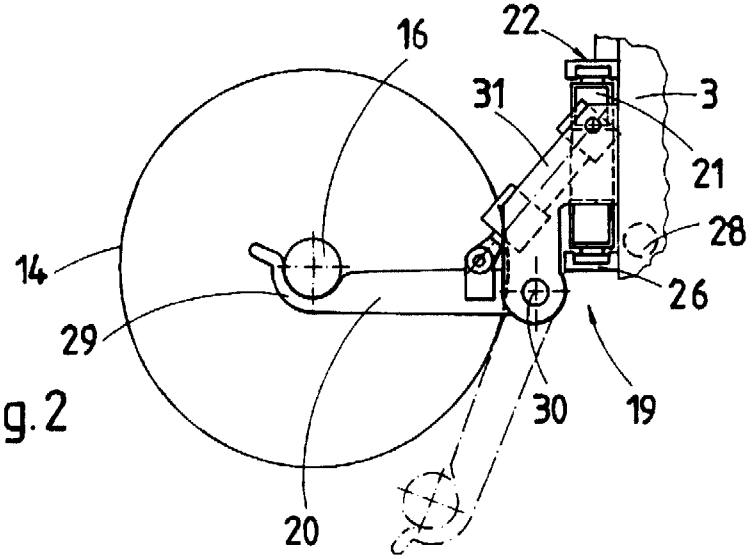
FIG. 2 is an enlarged fragmentary side view showing the holding device, taken in the direction of arrow II in FIG. 3.

The bearing arms 20 are positioned between horizontal guide 22 and broom housing 13, and comprise holding means 29 at free ends of the bearing arms spaced from the horizontal guide for holding broom shaft 16 in position, a shown in FIG. 2. In the illustrated embodiment, holding means 29 is simply constituted by an arcuate dip in each bearing arm 20, shaped to hold the broom shaft. If desired, the holding means could be a readily releasable snap connection or any other suitable device designed to hold broom shaft 16 temporarily on bearing arms 20.

In the illustrated embodiment, holding device 19 comprises carriage 21 displaceably guided in horizontal guide 22 and connecting the two bearing arms 20 to each other, each bearing arm being mounted on carriage 21 for pivoting about horizontal axis 30 extending in the transverse direction, and drive 31 is connected to each bearing arm 20 for pivoting the same.

As shown in FIG. 1, the holding device 19 is arranged below machine frame 3, and machine 1 further comprises crane 33 mounted on the machine frame thereabove. The crane is rotatable about a vertical axis and is vertically adjustable by drive means 32, and drive 32 is arranged for vertically adjusting the crane. Supports 34 are mounted on machine frame 3 within reach of crane 33 and are arranged one behind the other in the longitudinal direction for storing respective replacement ballast brooms 14.

A replacement ballast broom 14 stored on a support 34 is brought to broom housing 13 in the following manner:

Pivotal guide rail 26 is swung from its retracted into its extended position perpendicular to the longitudinal direction of machine frame 3 and is locked in the extended position by stop means 27. Transverse displacement drive 28 is then actuated to displace carriage 21 with bearing arms 20 into the extended position outside machine frame 3, as shown in FIG. 3, until carriage 21 is displaced to the end of guide rail 26. In this position, a replacement ballast broom can readily be lifted by crane 33 off support 34 and laid on bearing arms 20 of holding device 19. With the replacement ballast broom held on bearing arms 20, drive 28 is actuated again to displace the holding device transversely back into a centered position relative to the machine frame axis. In this position, pivoting drives 31 are actuated to lower bearing arms 20 (see phantom lines in FIG. 2) until ballast broom 14 comes to rest on track 6. Machine 1 is then slightly backed up until the replacement ballast broom resting on the track is aligned with broom housing 13, which meanwhile has been raised by drive means 12. The shaft of the replacement ballast broom may then be readily anchored in the shaft bearings of the broom housing.

A worn ballast broom 14 is removed from broom housing 13 simply by reversing the above-described procedure.

To enable the exchange of ballast brooms to be effectuated without problems in case there is traffic on a neighboring track on either side of the track on which work is done, it is advantageous to provide a pivotal guide rail 26 at each longitudinally extending side of machine frame 3. This opens the possibility of exchanging a ballast broom at either machine frame side.

It is also possible to lengthen bearing arms 20 so that they may hold two adjacently positioned ballast brooms 14 arranged one behind the other in the longitudinal direction of the machine frame.

What is claimed is:

1. A machine for carrying out work on a track, which comprises (a) a machine frame extending in a longitudinal direction and supported by undercarriages on the track for moving in an operating direction, (b) a broom housing, (c) a ballast broom having a horizontal shaft extending in a direction transverse to the longitudinal direction and rotatably mounted in the broom housing, (d) a holding device for temporarily storing the ballast broom, the holding device being mounted on the machine frame and comprising two bearing arms for supporting the horizontal shaft of the ballast broom, the bearing arms being spaced from each other in the transverse direction, (e) a horizontal guide extending in the transverse direction and displaceably guiding the holding device in the transverse direction, and (f) a drive connected to the holding device for displacing the holding device in the transverse direction.

2. The machine of claim 1, wherein the horizontal guide is comprised of two guide rails interconnected by a hinge having a vertical axis, one of the guide rails being affixed to the machine frame while the other guide rail is pivotal between an extended position perpendicular to the longitudinal direction and a retracted position extending in the longitudinal direction.

3. The machine of claim 2, further comprising stop means for locking the other guide rail in the extended and retracted positions.

4. The machine of claim 1, wherein the bearing arms are positioned between the horizontal guide and the broom housing and comprise holding means at free ends of the bearing arms spaced from the horizontal guide for holding the broom shaft in position.

5. The machine of claim 1, wherein the holding device comprises a carriage displaceably guided in the horizontal guide and connecting the two bearing arms to each other, each bearing arm being mounted on the carriage for pivoting about a horizontal axis extending in the transverse direction, and a drive connected to each bearing arm for pivoting the same.

6. The machine of claim 1, wherein the holding device is arranged below the machine frame, further comprising a crane mounted on the machine frame thereabove, the crane being rotatable about a vertical axis and being vertically adjustable, and a drive for vertically adjusting the crane.

7. The machine of claim 6, further comprising supports mounted on the machine frame within reach of the crane and arranged one behind the other in the longitudinal direction for storing respective ballast brooms.

8. The machine of claim 1, further comprising a ballast plow for distributing ballast in the track, the holding device for temporarily storing the ballast broom being arranged between the ballast plow and a rear one of the undercarriages in the operating direction.

* * * * *